US005348598A

United States Patent [19]

Vives et al.

[11] Patent Number: 5,348,598

[45] Date of Patent: Sep. 20, 1994

[54] METHOD OF MANUFACTURING A GUN BARREL PROVIDED WITH A LINING

[75] Inventors: Michel Vives, Eysines; Pierre Taveau; Georges Habarou, both of Le Bouscat; Francois Bognandi, Gradignan, all of France

[73] Assignee: Societe Europeenne De Propulsion, Suresnes, France

[21] Appl. No.: 892,179

[22] Filed: Jun. 2, 1992

[30] Foreign Application Priority Data

Jun. 6, 1991 [FR] France ..... 9106890

[51] Int. Cl.[5] ..... B65H 81/00

[52] U.S. Cl. ..... 156/93; 156/148; 156/169; 156/173; 156/175; 89/12; 501/95

[58] Field of Search ..... 89/12; 501/95; 156/148, 156/173, 175, 93, 169

[56] References Cited

U.S. PATENT DOCUMENTS 3,641,870 2/1972 Eig .
4,628,846 12/1986 Vives ..... 112/266.2 X
4,790,052 12/1988 Olry ..... 156/148 X
4,854,990 8/1989 David ..... 156/173
5,077,243 12/1991 Nakano ..... 501/95
5,132,169 7/1992 Olry et al. ..... 501/95 X

FOREIGN PATENT DOCUMENTS 2584107 6/1985 France .
2587083 9/1985 France .

*Primary Examiner*—Jeff H. Aftergut
*Attorney, Agent, or Firm*—Weingarten, Schurgin, Gagnebin & Hayes

[57] ABSTRACT

A gun barrel lining made of composite material having refractory fiber reinforcement and a ceramic matrix, the fiber reinforcement comprises a cylindrical inner portion constituted by a three-dimensional fiber texture and a cylindrical outer portion surrounding the inner portion and having the same axis, the outer portion being constituted by a strip wound around the inner portion, and the inner and outer portions being codensified by the ceramic matrix.

10 Claims, 2 Drawing Sheets

METHOD OF MANUFACTURING A GUN BARREL PROVIDED WITH A LINING

The present invention relates to a gun barrel lining, and more particularly to a lining made of composite material having refractory fiber reinforcement and a ceramic matrix.

BACKGROUND OF THE INVENTION

Research is continuously being performed to enable gun barrels to be subjected to ever increasing firing rates and pressures in order to increase performance, but without leading to deterioration that is too rapid.

In order to prevent a metal gun barrel heating up quickly, proposals have been made to line gun barrels with a ceramic material, in particular in the form of an inner coating or lining shrink-fitted to the inside of the gun barrel. Ceramics stand up well to high temperatures, thermal shock, wear, and corrosion, and they are also strong in compression, thereby making them suitable for such an application.

Ceramic matrix composites (CMCs) additionally provide ceramics with increased strength to withstand mechanical stresses and mechanical and thermal shocks, thereby imparting particularly advantageous thermostructural properties thereto.

Thus, the use of CMC within gun barrels has been proposed, in particular by the following patents: U.S. Pat. Nos. 4,435,455, 4,464,192, and 4,581,053.

An object of the present invention is to provide a gun barrel lining of ceramic matrix composite material which is particularly adapted to its conditions of use, in particular with respect to the structure of its fiber reinforcement.

SUMMARY OF THE INVENTION

According to the invention, this object is achieved by the fact that the fiber reinforcement comprises a cylindrical inner portion constituted by a three-dimensional fiber texture and a cylindrical outer portion surrounding the inner portion and having the same axis, the outer portion being constituted by a strip wound around the inner portion, and the inner and outer portions being codensified by the ceramic matrix.

The three-dimensional fiber texture is advantageously made up of superposed layers of two-dimensional texture (e.g. a fiber cloth or web) which are bonded together by needling. In a variant, the layers of two-dimensional texture are bonded together by implanting threads passing through the superposed layers.

After being densified with the matrix, the inner portion of the fiber reinforcement is constituted by a material that is particularly suitable for coming into contact with the projectile and its propellant gases.

The three-dimensional structure of the reinforcement is effective in countering delamination of the material (i.e. layers coming apart from one another). In addition, this three-dimensional structure confers a fine pore size to the fiber reinforcement that is more easily accessible for the matrix and that promotes more uniform densification, and thus lower final permeability to gases.

After being densified by the matrix, the wound outer portion of the fiber reinforcement constitutes a material that is strong when subjected to shrink-fitting, and in particular a material that is more suitable for shrink-fitting where it is prestressed in compression than is the material formed solely by the inner portion of the reinforcement.

By codensifying the inner and outer portions of the fiber reinforcement, the bonding achieved between these two portions is effective because of the continuity of the matrix at the interface between the two portions.

The refractory fibers constituting the fiber reinforcement are selected from carbon fibers and ceramic fibers.

The inner portion of the fiber reinforcement is preferably made of carbon fibers or of fibers constituting a carbon precursor, such as pre-oxidized polyacrylonitrile (PAN), which is more suitable for needling.

The outer portion of the fiber reinforcement is preferably made of ceramic fibers, e.g. fibers essentially constituted by silicon carbide, in particular for improving the thermal insulation provided by the lining.

Another object of the invention is to provide a method enabling the above-defined gun barrel lining to be manufactured.

The method of the invention comprises the steps consisting in:

- making a first cylindrical three-dimensional texture of fibers of refractory material or of a subsequently carbonized precursor thereof, thereby forming the inner portion of the reinforcement;
- winding a second texture of refractory fibers onto the inner portion of the reinforcement, thereby forming an outer portion of the reinforcement; and
- simultaneously densifying the inner portion and the outer portion of the reinforcement by means of the material that constitutes the ceramic matrix.

Advantageously, the inner portion of the reinforcement is made by winding superposed layers of fiber texture onto a mandrel and by bonding the layers together. The bonding between the layers may be achieved by needling the fiber texture to itself while it is being wound, or else by implanting threads.

The inner and outer portions of the reinforcement are preferably codensified by means of a gas or by means of a liquid.

Gas codensification is performed by chemical vapor infiltration.

Liquid codensification consists in impregnating the reinforcement with a liquid precursor for the matrix, and then in transforming the precursor, generally by heat treatment to obtain the matrix-constituting material.

BRIEF DESCRIPTION OF THE DRAWINGS

An embodiment of the invention is described by way of example with reference to the accompanying drawings, in which.

DETAILED DESCRIPTION

In a composite material gun barrel lining of the invention, the fiber reinforcement comprises two coaxial tubular cylindrical portions, an inner portion or inner ring, constituted by a three-dimensional fiber texture, and an outer portion or outer ring, constituted by a tape wound around the inner ring.

In the example described herein, the inner ring is made of carbon fibers and the outer ring is made essentially of silicon carbide fibers (SiC fibers).

Figure 1:
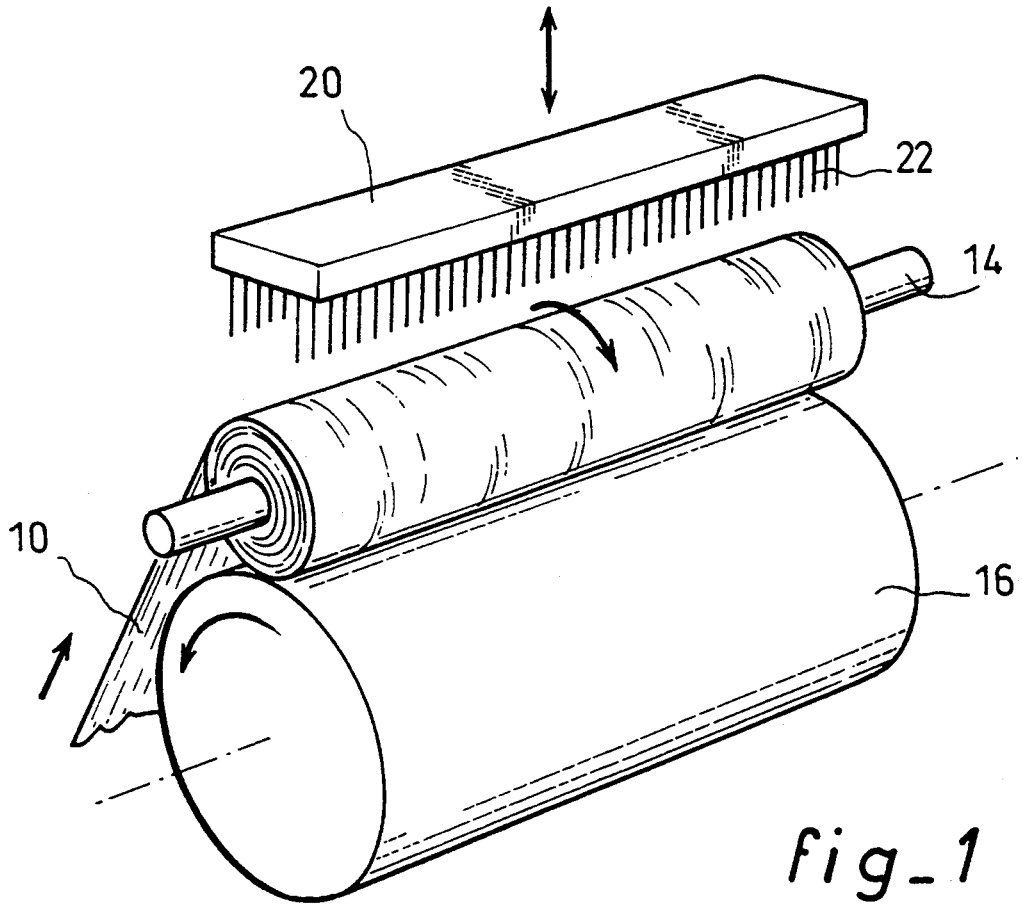
FIG. 1 is a diagrammatic perspective view showing how needling is performed on the inner portion of the fiber reinforcement of a composite ceramic gun barrel lining of the invention.

The inner ring is made of a fiber texture 10 in strip form made of pre-oxidized polyacrylonitrile (PAN) fibers that constitute a precursor for carbon fibers. The texture 10 is a composite sheet made up of a strip of pre-oxidized PAN cloth having a web of additional pre-oxidized PAN fibers preneedled thereto. The texture 10 is paid out from a storage roll to be wound with a small amount of tension onto a metal shaft 14 (FIG. 1). The diameter of the shaft 14 is selected as a function of the inside diameter of the lining that is to be made. A drive roll 16 winds the texture 10 at a determined speed about the shaft 14, with drive being provided by contact with the texture being wound.

While it is being wound onto the shaft 14, the texture 10 is needled by means of a needle board 20 provided with two rows of needles 22. The rows of needles run parallel to the shaft 14 over a length substantially equal to the width of the texture 10. The rows of needles are symmetrical to each other about an axial plane P running parallel to the needles 22, and they are spaced apart by a distance greater than the diameter of the shaft 14.

Figure 2:
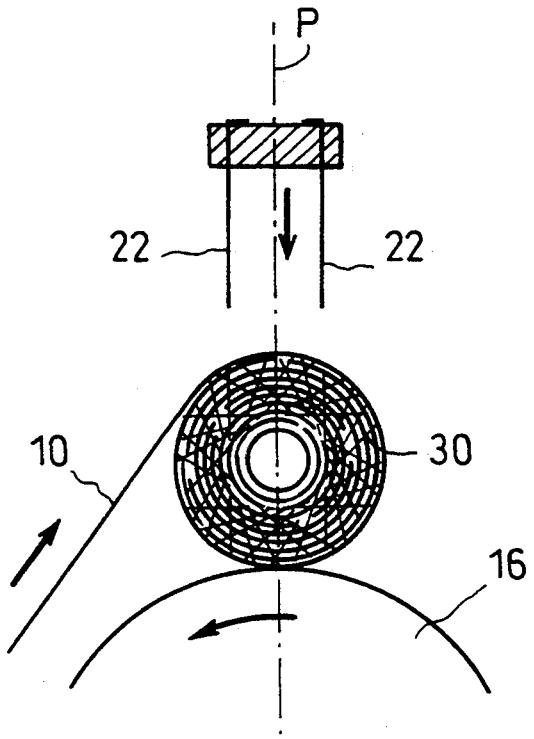
FIG. 2 is a diagrammatic section view showing the needling through the inner portion of the fiber reinforcement.

Thus, as can be seen in FIG. 2, the needles penetrate into the wound texture 10 on both sides of the shaft 14.

Advantageously, needling is performed by causing the needles to penetrate over a depth that is relatively constant while the texture 10 is being wound. To this end, each time the texture 10 has been wound one more turn round the shaft 14, the distance between the shaft 14 and the needle board 20 is increased at the back end of the needle board stroke by an amount that corresponds more or less to the thickness of one needled layer.

When the thickness desired for the inner ring 30 has been achieved, a plurality of finishing needling passes are performed without adding new texture 10, and while progressively reducing the depth to which the needles penetrate.

It may be observed that the needling method described above is analogous to that constituting the subject matter of Applicant's U.S. Pat. No. 4,790,052.

Each time the needles 22 penetrate, the barbs provided on the needles drag fibers, mostly taken from the web of pre-oxidized PAN, through the superposed layers of the texture 10. The disposition of the rows of needles on either side of the shaft 14 means that the fibers that are entrained by the needles run along directions that intersect (FIG. 2). By intersecting, the linking fibers between the layers make it possible to obtain a fiber structure that is very fine, i.e. a structure that has no large pores.

As mentioned above, the three-dimensional texture of the inner ring could be obtained by winding a two-dimensional texture, e.g. a strip of cloth, to build up a plurality of superposed layers which are bonded together by implanting threads through the layers. Such a method of obtaining a fiber preform is described in U.S. Pat. No. 4,628,846.

The inner ring of pre-oxidized PAN fibers is carbonized to transform the pre-oxidized PAN into carbon. During carbonization, the inner ring 30 is supported by a graphite shaft 24. The diameter of the graphite shaft 24 is slightly less than that of the shaft 14 so as to allow for the shrinkage of the texture during the transformation of pre-oxidized PAN into carbon.

After carbonization, the inner ring 30 is held in shape by a temporary binder, in particular by being impregnated by means of a resin that can easily be eliminated, e.g. by heat treatment, such as polyvinyl alcohol (PVA) resin that can be eliminated by heating without leaving any solid residue.

While the inner ring 30 is held in shape in this way, it may be machined to obtain a desired outside diameter and it may optionally be cut up into lengths if the total length of the ring 30 is several times the length of a lining.

Figure 3:
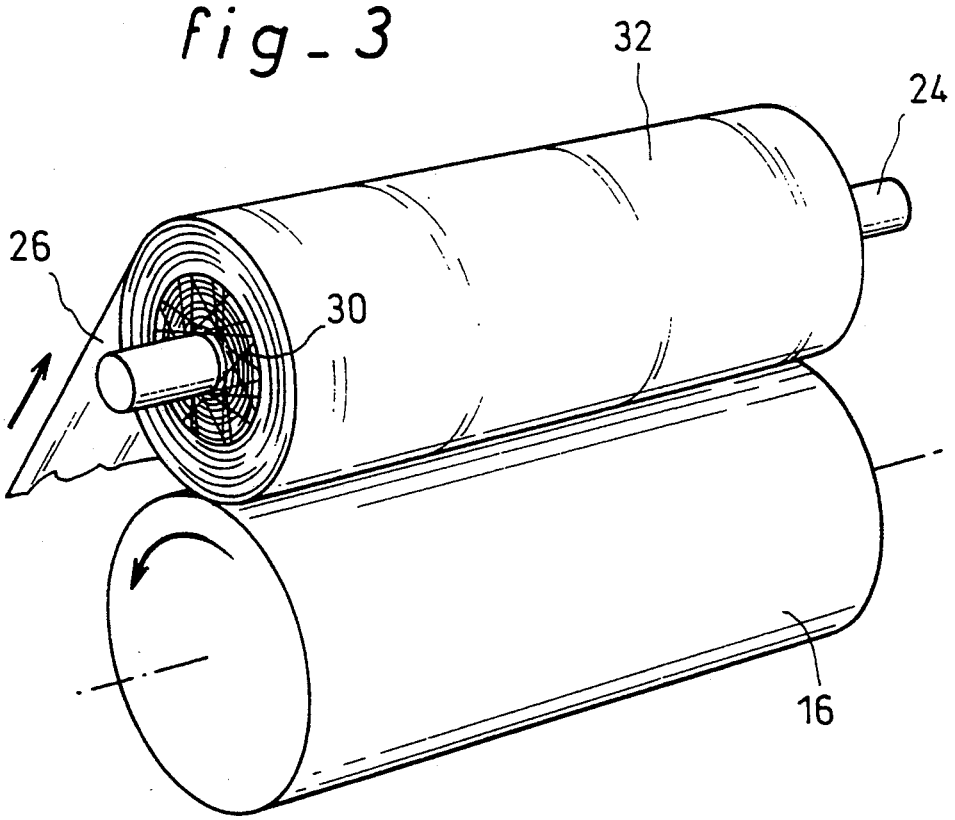
FIG. 3 is a diagrammatic perspective view showing how winding is used to make the outer portion of the fiber reinforcement of a gun barrel lining in accordance with the invention.

Thereafter (FIG. 3), the outer ring is installed around the inner ring carried by the shaft 24 by winding a strip texture 26 thereabout. The strip 26 is a strip of twill weave SiC fibers drawn from a storage roll. Winding is performed as before by means of a drive roll 16. At the beginning of winding, the strip of cloth 26 is glued to the surface of the ring 30 by the same resin as the resin used for impregnating the ring 30.

Once the outer ring 32 has achieved its outside diameter, unwinding of the strip of cloth 26 is prevented by a coil of carbon thread.

The fiber preform constituted by the inner ring 30 and the outer ring 32 mounted on the graphite shaft 24 is placed in a reaction chamber of a chemical vapor infiltration installation for the purpose of performing initial consolidation. The impregnating resin is eliminated during the temperature rise stage that precedes infiltration. Partial densification is initially performed by infiltrating material that constitutes the matrix for the purpose of consolidating the preform, i.e. for bonding the fibers together sufficiently to enable the perform to be manipulated.

The consolidated preform is removed from the infiltration installation to be machined to within a few tenths of a millimeter of its final dimensions, the shaft 24 having been removed.

Densification with the matrix then continues until maximum density is achieved, and the resulting gun barrel lining is machined to its final dimensions.

Codensification of the rings 30 and 32 ensures that they are bonded together by matrix continuity. The ceramic matrix may be silicon carbide, for example. The technique of making a ceramic matrix by chemical vapor infiltration is well known. Reference may be made in particular to the French patent published under the No. 2 401 888 in the name of the Applicant.

An interphase layer, e.g. of pyrocarbon (carbon deposited by chemical vapor infiltration) may be formed on the fibers of the preform prior to densification with the ceramic matrix. The formation of such an interface layer which improves the bonding between the fibers and the matrix is described in U.S. Pat. No. 4,752,503 in the name of the Applicant.

In a variant, the rings 30 and 32 may be codensified using a liquid. To this end, the preform is impregnated with a liquid that constitutes a precursor of the ceramic material of the matrix, and is then subjected to treatment, generally heat treatment, for transforming the precursor into the ceramic material. A plurality of consecutive impregnating cycles may be required.

Figure 4:
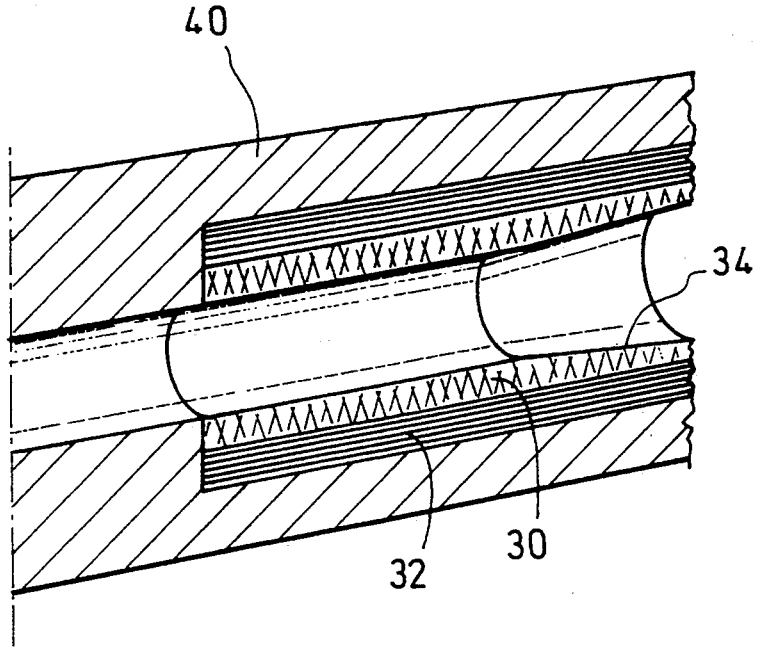
FIG. 4 is a highly diagrammatic perspective and section view showing a gun barrel lining of the invention shrink-fitted inside a gun barrel.

FIG. 4 shows the lining constituted by the codensified inner ring 30 and outer ring 32 mounted inside a metal gun barrel 40. The lining is disposed in the end portion of the barrel in the vicinity of its breech since that is the portion of the gun barrel which is subjected to greatest stress when a projectile is fired. There is no need to protect the bore of the gun barrel over its entire length and indeed it is undesirable to do so, since it is preferable to limit axial stresses due to differential expansion between the CMC lining and the metal gun barrel, and also to limit difficulties due to machining accuracy required for shrink-fitting purposes.

The lining is installed inside the gun barrel 40 by conventional shrink-fitting. Putting the lining under compression improves the transfer to the metal body of the barrel of forces due to a pressure rise inside the gun barrel.

The gun barrel lining of the invention provides good resistance to wear and satisfactory gas-tightness relative to the propellant gases because of the cohesion of the reinforcing fiber structure in the inner ring which provides great resistance to wear, and because of the fineness of said structure which promotes uniform and deep densification. The gun barrel lining also provides good resistance to pressure inside the barrel and provides good thermal insulation because of the way the reinforcing fiber structure is constituted in the outer ring (circumferential winding of a strip) and because of the insulating nature of said fiber structure.

A munitions-receiving cone 34 may be included in the bore of the lining (FIG. 4) for the purpose of shrink-fitting to the moving projectile so as to establish sealing between the projectile and the lining-receiving bore in the barrel. Such a cone gives rise to additional radial and axial stresses that the ceramic matrix composite material constituting the lining is capable of withstanding.

We claim:

1. A method of manufacturing a gun barrel lining in a composite material by forming a cylindrical fibrous reinforcement and densifying the reinforcement by a ceramic matrix, said method comprising the steps of:

providing a first fibrous texture;

winding said first fibrous texture in superposed layers and binding said superposed layers by causing fibers to extend transversely through said superposed layers, to form a cylindrical and three-dimensional inner portion of said reinforcement;

providing a second fibrous texture made of refractory fibers;

winding said second fibrous texture onto said inner portion of said reinforcement, to form a cylindrical outer portion of said reinforcement;

said inner portion of said reinforcement is made by winding and bonding together layers of fibers of a precursor of refractory fibers and the precursor is transformed into refractory fibers by heat treatment prior to winding of the second texture; and simultaneously densifying said inner portion of said reinforcement and said outer portion of said reinforcement with a ceramic matrix.

2. The method of claim 1, wherein said inner portion of said reinforcement includes carbon fibers.

3. The method of claim 1, wherein said first fibrous texture includes fibers of a carbon precursor.

4. The method of claim 3, wherein said first fibrous texture includes polyacrylonitrile.

5. The method of claim 1, wherein said second fibrous texture includes ceramic fibers.

6. The method of claim 1, wherein said binding includes needling.

7. The method of claim 1, wherein said binding includes implanting threads through said layers.

8. The method of claim 1, wherein said inner portion of said reinforcement is formed by winding superposed layers of said first fibrous texture and needling said layers together along directions that mutually intersect.

9. The method of claim 1, wherein said inner portion of said reinforcement and said outer portion of said reinforcement are codensified by chemical vapor infiltration.

10. The method of claim 1, wherein said inner portion of said reinforcement and said outer portion of said reinforcement are codensified by means of a liquid.

* * * * *